United States Patent [19]

McCoskey et al.

[11] 4,178,823

[45] Dec. 18, 1979

[54] PORTABLE ELECTRONIC MUSICAL INSTRUMENT

[76] Inventors: J. Marion McCoskey; R. Britton Webb, both of Box 225, Round Mountain, Calif. 96084

[21] Appl. No.: 940,252

[22] Filed: Sep. 7, 1978

[51] Int. Cl.[2] ..... G10H 1/00; G10H 5/00

[52] U.S. Cl. ..... 84/1.01; 84/DIG. 11; 84/DIG. 22

[58] Field of Search ..... 84/1.01, 1.03, 1.17, 84/1.24, DIG. 11, DIG. 22

[56] References Cited

U.S. PATENT DOCUMENTS

| | | | |
|---|---|---|---|
| 3,929,051 | 12/1975 | Moore | 84/1.17 |
| 4,055,103 | 10/1977 | Machanian | 84/1.01 |

*Primary Examiner*—S. J. Witkowski

*Attorney, Agent, or Firm*—Willis E. Higgins

[57] ABSTRACT

An electronic musical instrument has a keyboard including a plurality of scale keys and a plurality of chord keys. Musical sounds are generated by a programmable frequency divider network capable of producing different output frequencies, depending on which keys of the keyboard are activated. A decoding means connects the keyboard and the programmable frequency divider network to supply signals which cause the programmable frequency divider network to produce different output frequencies, depending on which keys of the keyboard are activated. Means connect the scale keys and the chord keys for altering signals supplied from the chord keys to the programmable frequency divider network, depending on which scale keys are activated. On this basis, compatible chords may be generated with the chord keys for a melody being played with the scale keys. The frequency divider network utilizes lowest common multiples and prime numbers, which substantially eliminates the potential for producing dissonant sounds. The lowest common multiple and prime number approach also allows fabrication of instruments which produce diatonic scales, e.g., modified Pythagorean and modified Zarlino scales, in addition to the chromatic scale. This electronic musical instrument may be provided in a single package and consitutes a musical analog to a portable electronic calculator.

23 Claims, 7 Drawing Figures

FIG. 4
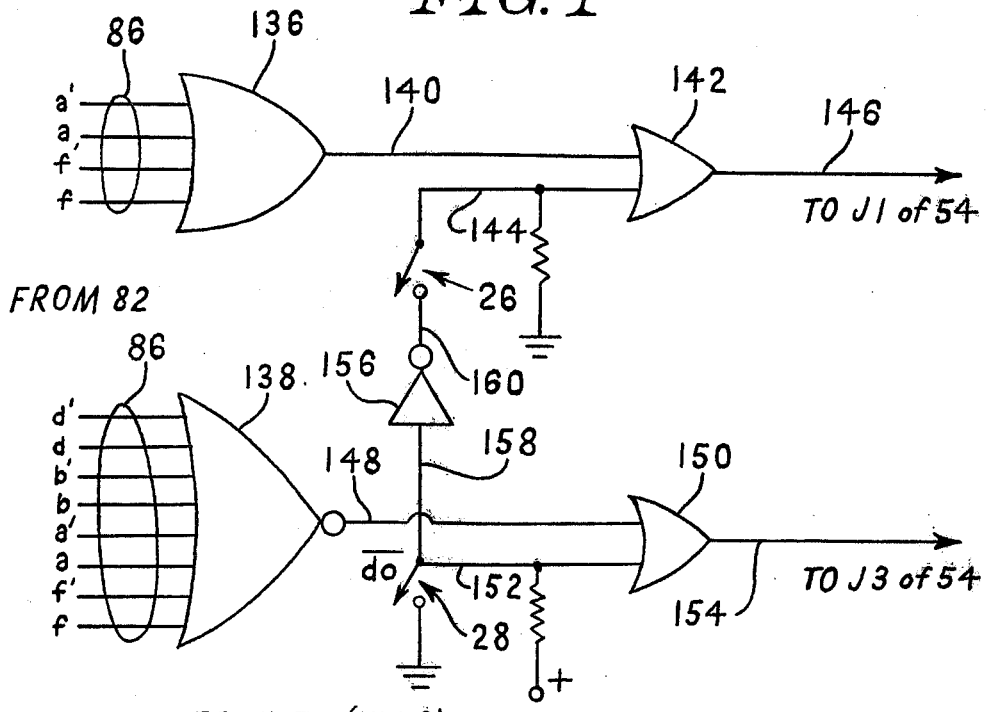
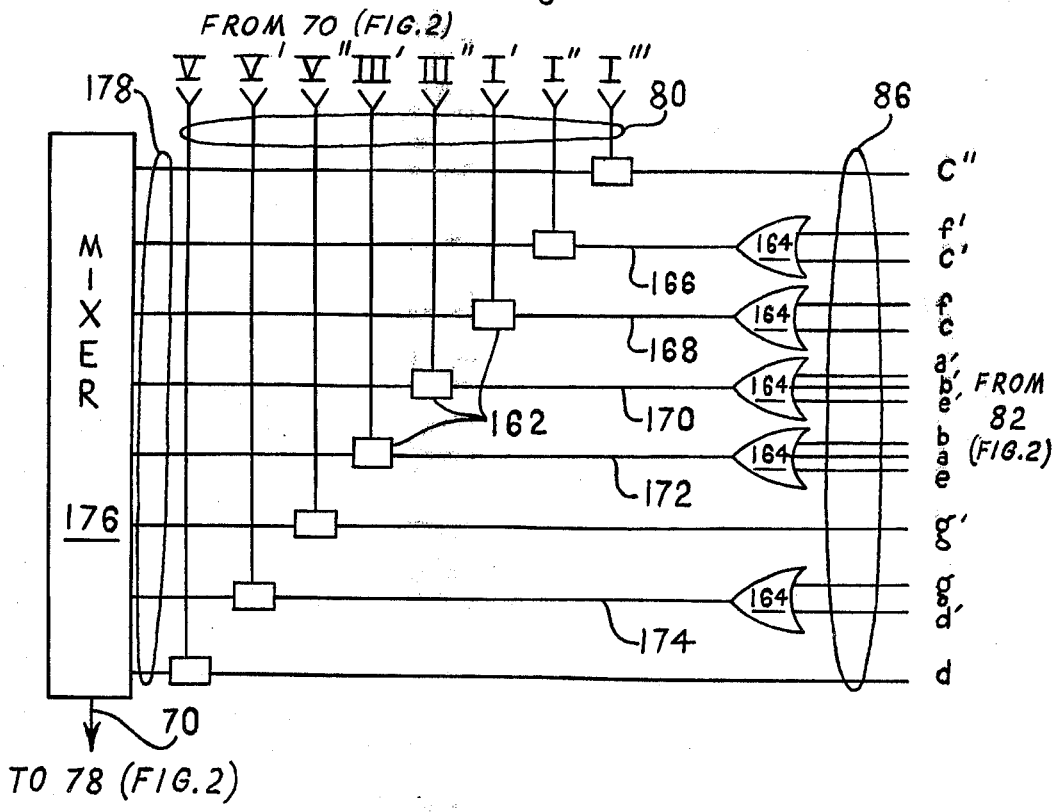
FIG. 5

PORTABLE ELECTRONIC MUSICAL INSTRUMENT

BACKGROUND OF THE INVENTION

1. Field of the Invention

This invention relates to an electronic musical instrument of simplified construction. More particularly, it relates to such a musical instrument which may be provided in a single, easily portable package. Most especially, it relates to such a musical instrument which is suitable both for playing musical compositions in different scales and for demonstrating and teaching basic musical concepts.

2. Description of the Prior Art

There are a wide variety of electronic musical instruments which are commercially available, including, for example, electronic organs and synthesizers. As originally developed, such electronic musical instruments relied primarily on analog circuitry and separate oscillators for the notes generated in their operation.

Subsequently, digital circuitry for generation of musical tones was developed. A typical digital frequency generation circuit comprises an oscillator, e.g., a quartz crystal, which generates a frequency higher than that of any musical tone to be produced using the circuit. A plurality of frequency divider circuits then divides the oscillator frequency in order to provide the notes of a musical scale. For example, the commercially available MM 5891 MOS Top Octave Frequency Generator Integrated Circuit obtainable from National Semiconductor Corporation, Santa Clara, California is typical of such a prior art frequency generation circuit in which a fully parallel frequency division network provides the notes of the conventional chromatic scale. U.S. Pat. No. 3,590,131 describes another example of a frequency divider network for obtaining chromatic scales. While such circuits have proved to be highly suitable for generating notes of the chromatic scale, they are limited to that scale. While most music of western cultures is composed in the chromatic scale, most non-western music is composed in other scales, usually one or another diatonic scale.

In addition to being limited to the chromatic scale, such fully parallel frequency divider networks as the MM 5891 utilize more circuit elements than would be required with a frequency generator network that was not fully parallel. Since integrated circuit designers continually attempt to provide either more function in a given area or a given function in a smaller area, a need remains for the development of frequency generator networks which utilize a lesser number of circuit elements than the commercially available fully parallel frequency generators.

The design and implementation of prior art electronic musical instruments has further tended to make them sufficiently complex that they are too cumbersome for ready portability. This consideration provides further impetus for the development of an improved electronic musical instrument with increased portability. Just as the development of easily portable calculators has expanded the use of electronic computation, the provision of a truly portable electronic musical instrument capable of generating a wide variety of pleasing musical sounds should expand the utilization of electronic music.

SUMMARY OF THE INVENTION

Accordingly, it is an object of this invention to provide an improved electronic musical instrument with sufficient flexibility for performing a wide variety of musical compositions, but which is small enough to be easily portable.

It is another object of the invention to provide a simplified, portable electronic musical instrument that has sufficient flexibility to allow its use for enhanced teaching of musical relationships.

It is a further object of the invention to provide an electronic musical instrument that is able to play musical compositions written in any of a plurality of scales.

It is a still further object of the invention to provide a design approach for an electronic musical instrument which will allow the fabrication of different instruments which generate musical sounds in accordance with different scales, but which utilize the same elements.

It is another object of this invention to provide an electronic musical instrument including the capability of treating a musical composition as a program, so that an individual lacking the ability or dexterity to play a particular composition may program the instrument to play the composition.

The attainment of these and related objects may be achieved through use of the novel electronic musical instrument herein disclosed. An electronic musical instrument in accordance with this invention includes a keyboard having a plurality of scale keys for playing the notes of a musical scale, which are normally employed for playing the melody of a musical composition. The keyboard also includes a plurality of chord keys in harmony with notes played by the scale keys. The instrument has a programmable frequency divider network which is capable of producing different output frequencies, depending on which keys of the keyboard are activated. Decoding means is connected between the keyboard and the programmable frequency divider network for supplying signals to cause the programmable frequency divider network to produce different output frequencies, depending on which keys of the keyboard are activated. Means connects the scale keys and the chord keys for altering signals supplied from the chord keys to the programmable frequency divider network, depending on which scale keys are activated.

In a preferred form of the invention, the frequency divider employed utilizes least common multiple and prime number frequency division circuits for frequency division. Such a frequency divider has an oscillator for generating a fundamental frequency to be divided. A first plurality of prime number frequency division circuits are connected to the oscillator. Each of the prime number frequency division circuits produces an output frequency which represents the fundamental frequency divided by a prime number. A second plurality of frequency division circuits is connected to the outputs of the first plurality of prime number frequency division circuits to produce additional frequencies by further division of the output frquencies produced by the first plurality of prime number frequency division circuits. The second plurality of frequency division circuits need not, but may, include further prime number frequency division circuits. The use of such prime number frequency division circuits enables musically significant frequencies to be generated with substantially fewer circuit elements than required with conventional, fully parallel frequency division networks.

The combination of the prime number frequency division circuits and the second plurality of frequency division circuits provides frequencies which are least common multiples of the desired set of frequencies representing a musical scale. Appropriate control signals, depending on which keys of the instrument are played, selectively gate the frequencies produced by the frequency divider to outputs of the divider for use in generating musical scales.

Increased flexibility is attained in the musical instrument by including both frequency division and frequency multiplication in a frequency producing network. In some instances, less circuitry is required to generate a given frequency by multiplying a frequency available in the network from dividing the fundamental frequency rather than obtaining the given frequency directly from the fundamental frequency by division.

In essence, in an especially preferred form the electronic musical instrument of this invention can both be played as a conventional musical instrument and programmed either from the keyboard or other input/output device to generate certain sound patterns that an individual lacks the ability to produce manually, In this sense, the instrument has the ability to treat a musical composition as a stored program and data used to control the instrument for the generation of sounds corresponding to the composition. In this form of the invention, a microprocessor or other suitable data processing means is provided in the instrument to operate in accordance with the program and data entered into suitable memory means forming a part of the system. In this form of the invention, scores may be entered and run as a program in the instrument rather than merely manually played.

This ability means that complex compositions unplayable except by a number of musicians in a group or even a full orchestra can be programmed into the instrument and generated by it without use of a recorded performance.

It should be recognized that an electronic musical instrument of this invention, like a pocket calculator, can come in a variety of models. Simple models may lack the ability to run a stored program entered by the user, but more powerful models may generate full orchestration, rhythm, crescendo, and the like in response to a user entered program.

The attainment of the foregoing and related objects, features and advantages of the invention should be more readily apparent after review of the following more detailed description of the invention, taken together with the drawings, in which:

BRIEF DESCRIPTION OF THE DRAWINGS

FIG. 4 is a schematic diagram of another portion of the circuitry shown in FIG. 2;

FIG. 5 is another more detailed block diagram of a further portion of the circuitry shown in FIG. 2;

DETAILED DESCRIPTION OF THE INVENTION

Figure 1:
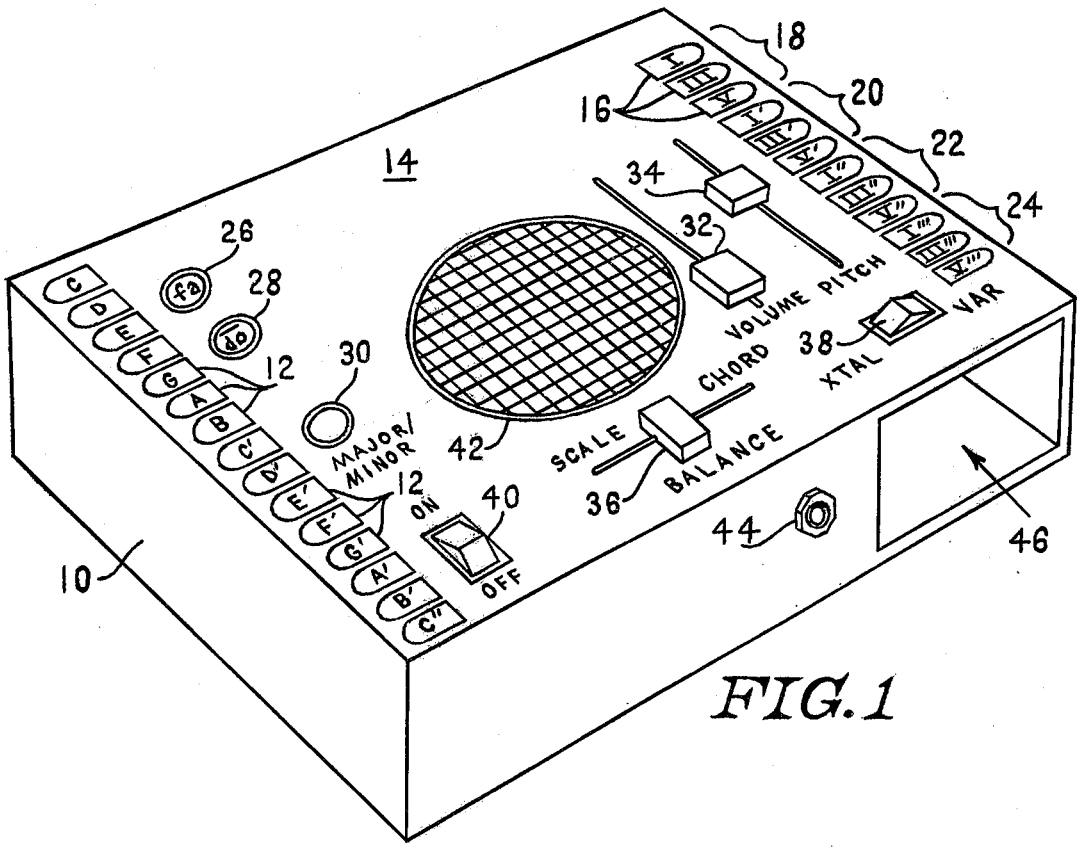
FIG. 1 is an external perspective view of an electronic musical instrument in accordance with the invention.

Turning now to the drawings, more particularly to FIG. 1, there is shown an electronic musical instrument in accordance with the invention. The instrument has a suitable case or cabinet 10. A plurality of scale keys 12 are positioned along one side of the top surface 14 of case 10. It should be noted that the scale keys provide the conventional eight notes for each of two octaves. A plurality of chord keys 16 are provided along the other side of top 14 of the instrument. The chord keys 16 are arranged in four groups 18–24 of three keys each, with the four groups 18–24 being octavely related. Thus, the chord keys span four octaves. Additionally, there are two chord buttons 26 and 28 provided on the top face 14 of the instrument. These chord buttons are utilized in conjunction with the scale keys to alter the nature of the chords produced through use of the chord keys 16, as will be explained in further detail below. Major-minor switch 30 allows the generation of major or minor scales and chords, depending on which mode has been selected. Slide switch 32 allows adjustment in the volume of tones produced by the instrument. Slide switch 34 allows the pitch of the instrument to be adjusted. Slide switch 36 adjusts the relative volume of the scale notes and chord notes produced by the instrument.

Switch 38 allows the pitch of the instrument to be locked by a crystal at C' equal to 256 Hz. (see FIG. 3), if in the XTAL position, or allows the pitch to be adjusted with slide switch 34 from subsonic to ultrasonic frequencies with switch 38 in the VAR position. A conventional on/off switch 40 and a speaker 42 are also mounted on the top 14 of the instrument. Jack 44 allows connection to an external speaker, and battery compartment 46 holds conventional nine volt transistor batteries for operation of the instrument.

Before describing the circuitry of the electronic musical instrument of this invention further, there are certain fundamental relations of musical sounds that are employed in the instrument, which should be reviewed for ease of understanding. It is, of course, well known that three tones whose frequencies are related to each other as 4, 5, and 6 produce, when sounded together, a very pleasing effect. Such tones constitute a major triad or major chord. In effect by using the major triad three times as a measuring rod, the major diatonic scale can be constructed. Table I below illustrates how this may be done.

Table I

| Major scale built on middle C | I' c' | II' d' | III' e' | IV' f' | V' g' | VI' a' | VII' b' | 8va c'' | II'' d'' |
|---|---|---|---|---|---|---|---|---|---|
| Tonic chord | c' 4 | — | e' 5 | — | g' 6 | — | — | — | |
| Dominant chord | — | d'* | — | — | g' 4 | — | b' 5 | — | d'' 6 |
| Subdominant chord | — | — | — | f' | — | a' | — | c'' | |

Table I-continued

| | | | | 4 | | 5 | | 6 | |
|---|---|---|---|---|---|---|---|---|---|
| Frequencies | 256 | 288 | 320 | 341.3 | 384 | 426.6 | 480 | 512 | 576 |
| Syllable | do | re | mi | fa | sol | la | ti | do | |
| Ratio to key note c' | 1/1 | 9/8 | 5/4 | 4/3 | 3/2 | 5/3 | 15/8 | 2/1 | |
| Interval | 9/8 | 10/9 | 16/15 | 9/8 | 10/9 | 9/8 | 16/15 | | |

*Derived by dividing d" by 2

As shown in the table, a middle C scale can be generated from a tonic chord, its dominant chord, and its subdominant chord. This electronic musical instrument constructs scales in the same manner, using frequency dividers and logic circuits.

Figure 2:
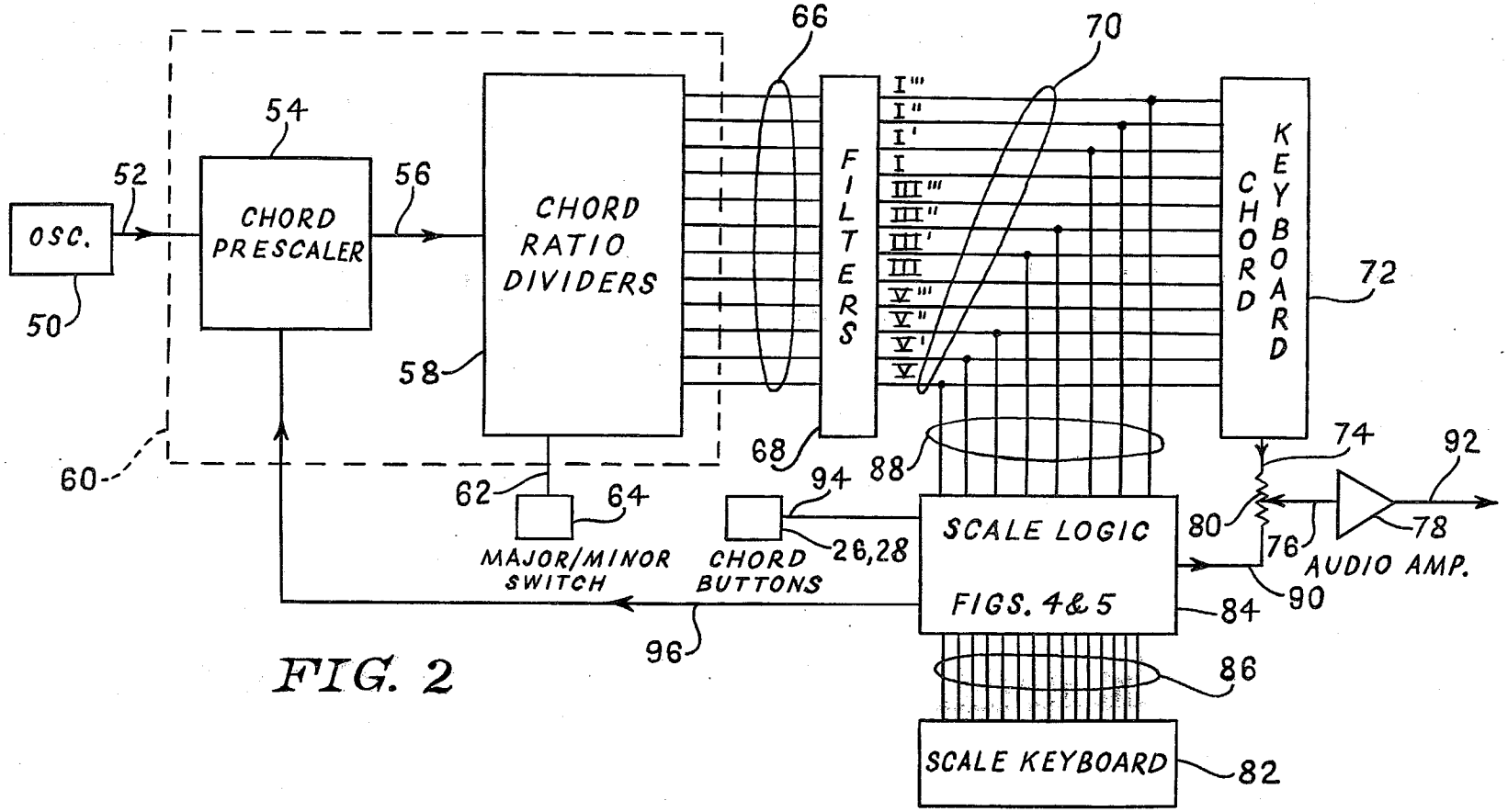
FIG. 2 is a generalized block diagram of circuitry for the electronic musical instrument shown in FIG. 1.

Turning now to the generalized block diagram of FIG. 2, elements of the circuitry for an electronic musical instrument in accordance with the invention are shown. An oscillator 50 produces a fundamental frequency from which all of the other frequencies used in the instrument are generated. As should be apparent from the discussion of FIG. 1, oscillator 50 either produces a fixed frequency higher than that desired for any note to be played, or operates as a voltage controlled oscillator to allow variation in the pitch of the instrument. Output 52 of the oscillator 50 is connected to chord prescaler 54. The chord prescaler 54 divides the fundamental frequency by 8, 9 or 12, depending on which scale keys 12 (FIG. 1) are pressed and whether chord buttons 26 and 28 are pressed. Output 56 of the chord prescaler 54 is connected to chord ratio dividers 58 which produces frequencies corresponding to notes used to form the chords. As in the case of the prescaler 54, the chord ratio dividers 58 divide the prescaled frequency by different numbers, depending on which scale keys are being played. The chord prescaler 54 and the chord ratio dividers 58 together constitute a programmable frequency divider 60, which will be explained in further detail in connection with the discussion of FIG. 3. Connection 62 couples major/minor switch 64 to the chord ratio dividers 58. Outputs 66 of the chord ratio dividers 58 are connected to voice filters 68. The filters 68 remove frequencies not desired for the generation of audible tones with the instrument, as well as any random noise signals. A like number of outputs 70 from filters 68 provide desired frequencies to chord keyboard 72. Chord keyboard 72 includes the chord keys 16 (FIG. 1) and acts to gate the frequencies at outputs 70 from filters 68 to line 74, which is connected to input 76 of audio-amplifier 78 through potentiometer 80, which adjusts volume. Scale keyboard 82, including the scale keys 12 (FIG. 1), is connected to scale logic 84 by lines 86. Selected ones of the outputs 70 as shown are connected to scale logic 84 by means of input lines 88 to allow generation of frequencies corresponding to a musical scale in accordance with the relationships discussed in connection with Table I above. In a similar manner to chord keyboard 72, scale keyboard 82 is used to gate the scale frequencies to output 90 of scale logic 84 and, through potentiometer 82, to audio-amplifier 78. Output 92 of audio-amplifier 78 is connected to speaker 42 (FIG. 1) for generation of the musical sounds.

Chord buttons 26, 28 are connected through scale logic 84 to prescaler 54 by means of lines 94 and 96. Operation of the chord buttons 26, 28 as explained above changes the key of a chord produced using keyboard 72 altering the frequency division factor of prescaler 54. In this manner, the chord buttons may be used to produce chords in the keys of C, F and G, depending on which of them is depressed. If neither is depressed, a C chord is generated.

Figure 3:
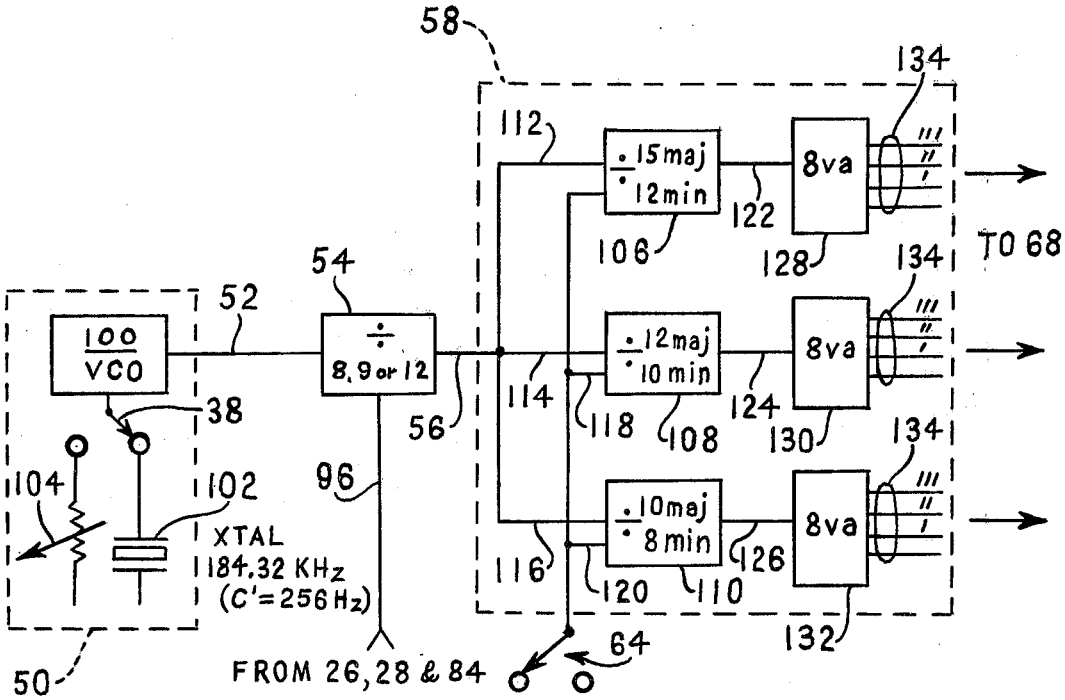
FIG. 3 is a schematic diagram of a portion of the circuitry shown in FIG. 2.

FIG. 3 shows further details of the programmable frequency divider network 60 shown in FIG. 2. The oscillator 50 operates as a voltage or crystal-controlled oscillator depending on whether VCO 100 is connected to crystal 102 or to potentiometer 104 by means of switch 38. If VCO 100 is connected to crystal 102, the frequency supplied to line 52 is 184.32 HHz. If VCO 100 is connected to potentiometer 104, the frequency on line 52 may be varied, e.g., between about 40 KHz and about 200 KHz.

Prescaler divider 54 divides the frequency supplied on line 52 by 8, 9 or 12, depending on the inputs received from chord buttons 26, 28 and scale logic 84 (FIG. 2). The prescaler divider 54 is most easily implemented as a programmable counter. The resulting frequency supplied to output 56 of the prescaler divider 54 is one of three frequencies, whose ratios are as C:F:G, depending on which division factor is employed as a result of the inputs on line 96. The signal on line 56 is then supplied to three parallel counters 106, 108 and 110 by lines 112, 114 and 116 respectively. These parallel counters 106–110 are a part of chord ratio dividers 58. The parallel counters 106, 108 and 110 divide the signal from line 56 by the numbers necessary to obtain the frequency ratios of a major or minor chord. For a major chord, those numbers are 15, 12 and 10 for counters 106, 108 and 110, respectively. For a minor chord, the corresponding numbers are 12, 10 and 8. The use of the major or minor divisors depends on the position of major/minor switch 64, connected to counter 106 by line 62, and to counters 108 and 110 by line 62 and lines 118 and 120, respectively.

The output signals from parallel counters 106, 108 and 110 are supplied on lines 122, 124 and 126, respectively to three parallel octave dividers 128, 130 and 132, respectively. Each octave divider produces four octaves of each note of a chord on their respective outputs 134. The resulting total of 12 notes pass through voicing filters 68 (FIG. 2) to chord keyboard 72. As indicated in FIG. 2, eight of these 12 notes are supplied on input lines 88 to scale logic 84 to construct scale frequencies under the control of scale logic 84.

The further details of the scale logic 84 are shown in FIGS. 4 and 5. FIG. 4 shows how the scale logic 84 determines the proper divisor for prescaler divider 54, depending on scale keyboard 82 closures or use of chord buttons 26, 28. This chord prescaler logic portion of scale logic 84 includes a four input or gate 136 and an eight input or gate 138. Input lines 86 from scale keyboard 82 (FIG. 2) are connected to the or gates 136 and 138 from the scale keys 12 (FIG. 1) in accordance with the designations shown in FIG. 4. Output 140 of or gate 136 forms one input of a two-input or gate 142. The other input into or gate 142 is supplied by chord button 26 on line 144. Output 146 of or gate 142 is connected to a J1 input of chord prescaler 54.

Output 148 of or gate 138 forms one input of two-input or gate 150. The other input of or gate 150 is provided by chord button 28 on line 152. Output 154 of or gate 150 is connected to a J3 input of chord prescaler 54. Inverter 156 connected between chord buttons 26 and 28 by lines 158 and 160 assures that the chord button 26 will have no effect if pressed without pressing chord button 28 at the same time, to avoid invalid logic. This particular scheme is necessary to avoid a situation in which a person playing the instrument must simultaneously release one key and press another. Doing so is difficult and may produce an intermediate state heard as a "chirp."

Table II below is a truth table of the prescaler logic of FIG. 4 and J1-J4 inputs of the chord prescaler 54.

Since the J2 and J4 inputs are always "zero" and "one", respectively, they are not shown in the drawings and may be connected to two different potential levels in the system which do not change during its operation to represent these states.

TABLE II

| I | III | V | J1 | J3 | J2 | J4 |
|---|---|---|---|---|---|---|
| C | E | G | 0 | 1 | 0 | 1 |
| | B | D | 0 | 0 | 0 | 1 |
| F | A | | 1 | 0 | 0 | 1 |

In essence, the prescaler logic portion of scale logic 84 shown in FIG. 4 determines from scale keyboard 82 closures whether a chord to be played with the scale note or notes being played should be in the key of C, F or G and sends the appropriate logic signals to the programmable counter constituting prescaler divider 54 in FIG. 3. If the chord keyboard 72 is to be played without using the scale keyboard 82, the appropriate signals are generated by use of the chord buttons 26 and 28.

FIG. 5 shows details of the portion of scale logic 84 used to obtain scale notes from selected ones of the chord signals on lines 70 (FIG. 2), in response to scale keyboard 82 closures. As shown, input lines 86 from scale keyboard 82 (FIG. 2) are either directly connected to transmission gates 162 or are connected to one of a plurality of or gates 164. The outputs of the or gates 164 are each connected to one of the transmission gates 162 by lines 166, 168, 170, 172 and 174, respectively. The other input to the transmission gates 162 comes from selected ones of the chord signal lines 70 on lines 80 as necessary to generate the scale notes from the chord signals on lines 70, as explained above in connection with Table I. The signals resulting from scale keyboard 82 closures on lines 86 or lines 166–174 enable transmission gates 162 to pass the signals supplied to transmission gates 162 on lines 80 to mixer 176 via lines 178. Mixer 176 operates as a summing amplifier to incorporate all of the signals presented to mixer 176 as a result of scale keyboard 82 closures. The resulting combined signal is supplied on output line 90 to audio amplifier 78 (FIG. 2).

Figure 6:
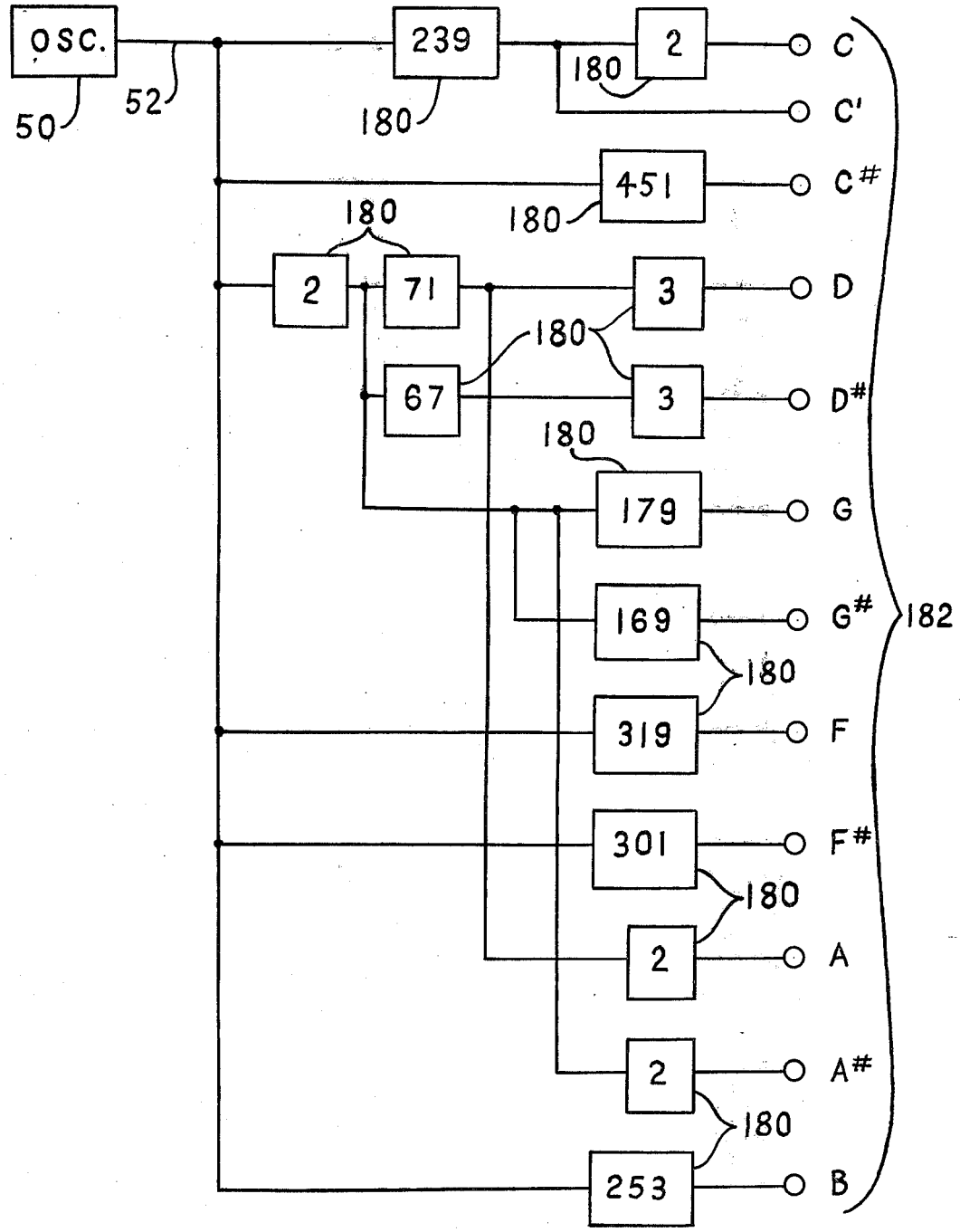
FIG. 6 is a block diagram of a frequency divider circuit for use in the electronic musical instrument of this invention.

Turning now to FIG. 6, a chromatic frequency divider network for use in an electronic musical instrument as described above is shown. While this circuit utilizes prime number and least common multiple divisors to the extent possible, it should be recognized that the least common multiple of the conventional chromatic scale is essentially infinite. The least common multiple of the circuit shown is about $4.52\times10^{21}$.

As above, oscillator 50 produces a fundamental frequency on its output line 52. A plurality of frequency division circuits 180 are connected to line 52 directly and indirectly as shown to produce the divider network. The numbers inside each block representing a frequency division circuit 180 represent the divisor employed for that circuit. The frequency division circuits are counters which produce a single output pulsed for each quantity of input pulses corresponding to the divisors shown. The resulting outputs 182 of the network provide frequencies of the proper ratio for the notes shown. Obviously, the pitch of these notes will depend on the fundamental frequency supplied by oscillator 50 on line 52.

Implementing the frequency divider network of FIG. 6 requires a total of 77 flip-flop circuits. In comparison, a conventional fully parallel 12-channel chromatic frequency division network requires 115 flip-flops. Thus, even for a scale with an essentially infinite least common multiple, a substantial reduction in circuit complexity is obtained by using prime numbers and least common multiples to the extent possible for this scale. Additionally, the circuit shown is a fully compatible pin-for-pin equivalent in integrated circuit form for the presently available fully parallel network integrated circuit networks.

The frequency division networks in accordance with this invention are even more advantageous when employed with scales having relatively small least common multiples. Two such scales are shown below in Table III.

TABLE III

| | Note | Frequency Ratio (Modified Pythagorean) | Frequency Ratio (Modified Zarlino) |
|---|---|---|---|
| 12 | C | 2 | 2 |
| 11 | B | 243/128 | 15/8 |
| 10 | A# | 9/5 | 9/5 |
| 9 | A | 27/16 | 5/3 |
| 8 | G# | 8/5 | 8/5 |
| 7 | G | 3/2 | 3/2 |
| 6 | F# | 64/45 | 64/45 |
| 5 | F | 4/3 | 4/3 |
| 4 | E | 81/64 | 5/4 |
| 3 | D# | 6/5 | 6/5 |
| 2 | D | 9/8 | 9/8 |
| 1 | C# | 16/15 | 16/15 |
| 0 | C | 1 | 1 |

The table shows the notes of these scales and their corresponding frequency ratios for each scale. The modified Pythagorean and modified Zarlino scales are respectively 12-tone scales based on the 8-tone Pythagorean and Zarlino scales respectively. The modified Zarlino scale is probably the most practical for use, since it would appeal to the geatest number of musicians.

Figure 7:
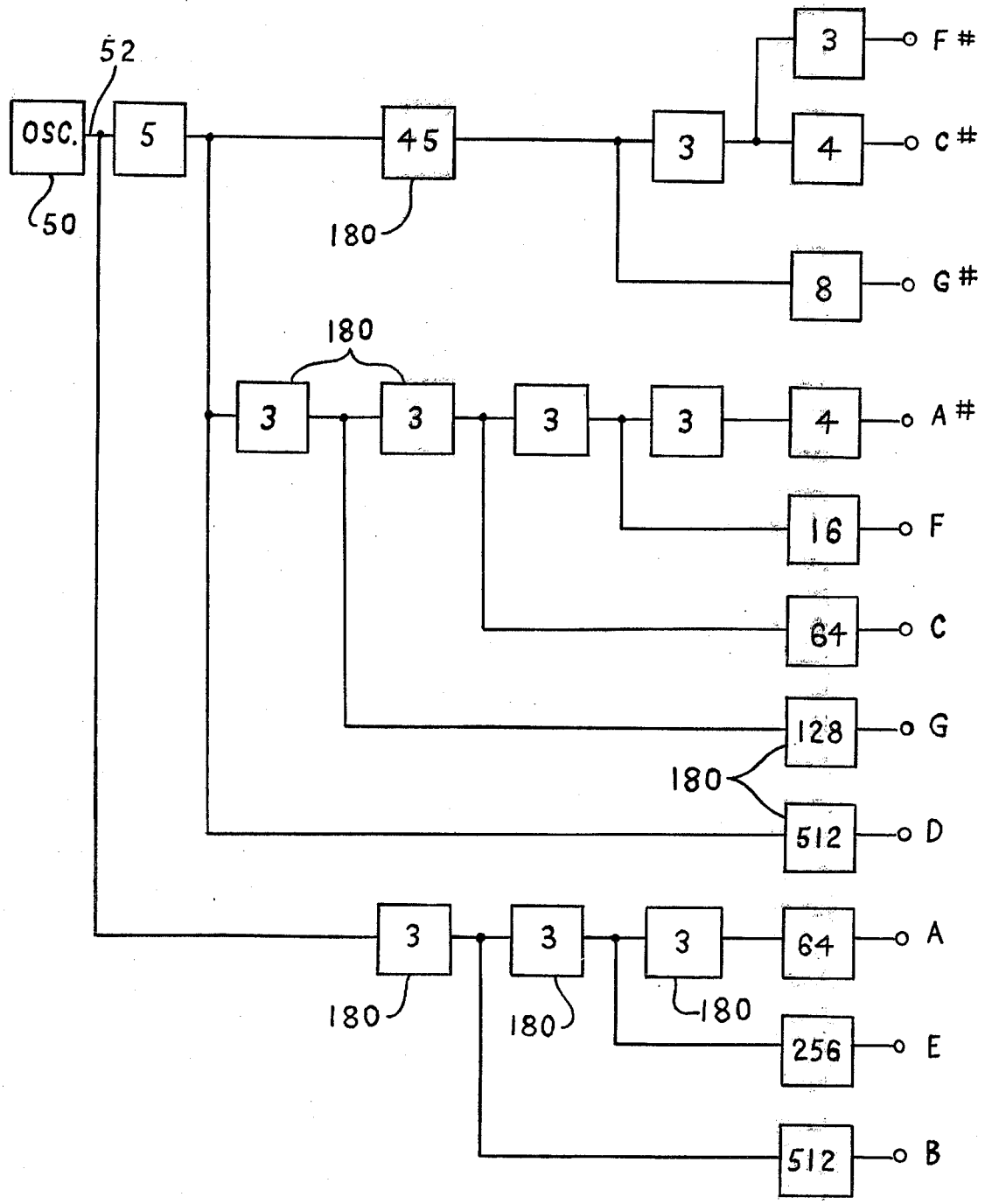
FIG. 7 is a block diagram of another frequency division circuit suitable for use in the electronic musical instrument of this invention.

FIG. 7 shows a frequency divider network suitable for producing the modified Zarlino scale shown in Table 3. As in the case of FIG. 6, an oscillator 50 provides a fundamental frequency at output 52, which is then supplied to a plurality of frequency division circuits 180 for generation of frequencies corresponding to the scale at outputs 182. Again, the numbers in frequency division circuit 180 represent the divisor employed in that circuit. Substantial simplification of this network has been obtained by starting with the largest prime number factors and by employing the least common multiples of the desired frequencies. A similar frequency divider network can be provided for generation of frequencies corresponding to the modified Pythagorean scale shown in Table 3.

In addition to the above relatively simple embodiment of a musical instrument in accordance with the invention, microprocessor, random access memory, read only memory and related integrated circuits can be used to provide a user programmable, stored program embodiment of the invention. Given suitable peripheral devices, the instrument could accept data and program input from a plug-in semiconductor module, a magnetic tape or card, a disk, and the like. Such a more complex system could be programmed to generate musical sounds corresponding to a musical score under control of a suitable operating program.

It should now be apparent that a simplified electronic musical instrument and frequency division network capable of achieving the stated objects of the invention has been provided. Because of the simplified frequency divider networks and the shared use of circuitry for generating both chords and scales, a compact, easily portable musical instrument is obtained. Because of the manner in which the signals are generated by frequency division and combination, the instrument is unusually well suited to program control to allow the user to generate musical compositions other than by playing the instrument manually and without a recorded performance.

It should further be apparent to the art skilled that various changes in form and details of the invention may be made. It is intended that such modifications be included within the spirit and scope of the claims appended hereto.

What is claimed is:

1. A portable electronic musical instrument, which comprises:

(a) a keyboard including a plurality of scale keys and a plurality of chord keys, (b) a programmable frequency divider network capable of producing different output frequencies depending on which keys of said keyboard are activated, (c) decoding means connected between said keyboard and said programmable frequency divider network for supplying signals to cause said programmable frequency divider network to produce different output frequencies depending on which keys of said keyboard are activated, and (d) means connected between said scale keys and said programmable frequency divider network for altering the output frequencies for generating chords produced by said programmable frequency divider network, the alteration being based on scale key closures so that chords produced from the output frequencies are compatible with scale notes corresponding to the scale key closures.

2. The electronic musical instrument of claim 1 additionally comprising:

(e) means for selecting a key of notes from which the plurality of chord keys of said keyboard select to produce a given chord.

3. The electronic musical instrument of claim 1 additionally comprising:

(f) means connected to said programmable frequency divider for selecting a major or a minor mode for generation of the output frequencies.

4. An electronic musical instrument which comprises:

(a) an oscillator for producing a fundamental frequency, (b) frequency division means for providing a plurality of frequencies that may be combined to produce chords from the fundamental frequency on a plurality of outputs from said frequency division means, (c) a chord keyboard connected to the plurality of outputs from said frequency division means for selectively supplying said plurality of frequencies as a chord to an output of said chord keyboard in response to key closures on said chord keyboard, (d) means connected to at least enough of the plurality of outputs from said frequency division means to provide signal frequencies corresponding to a scale of notes from the chord signals on the outputs as connected, (e) a scale keyboard connected to said scale note frequency providing means for selectively gating scale note frequencies to an output of said scale note frequency providing means in response to key closures on said scale keyboard, and (f) a sound producing means connected to the output of said chord keyboard and to the output of said scale note frequency providing means.

5. The electronic musical instrument of claim 4 additionally comprising:

(g) means connected to said frequency division means for selectively causing said frequency division means to generate the plurality of frequencies in a major or a minor mode.

6. The electronic musical instrument of claim 4 additionally comprising:

(g) means connected between said scale keyboard and said frequency division means for altering the plurality of frequencies produced by said frequency division means based on scale keyboard key closures so that chords produced from said plurality of frequencies are compatible with scale notes corresponding to the scale keyboard key closures.

7. The electronic musical instrument of claim 4 in which said frequency division means comprises a network of counter circuits, each of which produces an output in response to a predetermined plurality of input pulses.

8. The electronic musical instrument of claim 7 in which the network of counter circuits includes a first plurality of the counter circuits with inputs connected to said oscillator and in which the predetermined plurality of input pulses is a prime number, at least some of the first plurality of counter circuits having outputs connected to a second plurality of counter circuits to produce additional frequences by further division of output frequencies produced by said first plurality of counter circuits.

9. The electronic musical instrument of claim 4 in which said oscillator is a crystal controlled oscillator.

10. The electronic musical instrument of claim 4 in which said oscillator is a voltage controlled oscillator.

11. The electronic musical instrument of claim 4 additionally comprising:

(g) means for adjusting the relative volume of chords and scale notes produced by said sound producing means.

12. The electronic musical instrument of claim 8 in which said second plurality of counter circuits include at least one lowest common multiple of at least two of the output frequencies.

13. A self contained, portable electronic musical instrument, which comprises a static system including:

(a) a keyboard having a plurality of scale keys, a plurality of chord keys, and keys for selecting a key of notes from which the chord keys may be used to generate chords, (b) means for generating a fundamental frequency, (c) a prescaler frequency divider connected to said fundamental frequency generating means and to said key of notes selection keys for dividing the fundamental frequency by different divisors depending on selective actuation of said key of notes selection keys, (d) a programmable frequency divider network connected to receive a selected output frequency from said prescaler frequency divider and to said scale and chord keys and capable of producing different output frequencies depending on which of said chord and said scale keys of said keyboard are activated, and (e) sound generation means connected to receive output frequencies from said programmable frequency divider network.

14. The electronic musical instrument of claim 13 additionally comprising:

(b) means connected to said programmable frequency divider network for selecting a major or a minor mode for generation of the output frequencies, said programmable frequency divider network dividing the output frequency from said prescaler frequency divider by a different divisor depending on whether the major or minor mode is selected.

15. The electronic musical instrument of claim 14 in which the different major or minor mode divisors are, respectively, 15 and 12.

16. The electronic musical instrument of claim 13 in which the key of notes selection keys select from the keys of notes C, F and G.

17. The electronic musical instrument of claim 16 in which the different divisors employed by said prescaler frequency divider are, respectively, 8, 9 and 12.

18. The electronic musical instrument of claim 13 in which said scale keys are also connected to said prescaler frequency divider for dividing the fundamental frequency by different divisors depending on selective actuation of said scale keys to transform otherwise dissonant scale notes being played to compatible scale notes.

19. An electronic musical instrument, which comprises:

(a) an oscillator for producing a fundamental frequency, (b) a keyboard including a plurality of scale keys and plurality of chord keys, (c) a prescaler frequency divider connected to receive the fundamental frequency from said oscillator and said scale keys of said keyboard for dividing the fundamental frequency by different divisors depending on selective actuation of said scale keys, to transform otherwise dissonant scale notes being played to compatible scale notes, (d) a programmable frequency divider network connected to receive a selected output frequency from said prescaler frequency divider and to said scale keys and said chord keys and capable of producing different output frequencies depending on which of said scale keys and said chord keys are activated, and (e) sound generation means connected to receive output frequencies from said programmable frequency divider network.

20. The electronic musical instrument of claim 19 in which said programmable frequency divider supplies output frequencies for generating chords in response to chord key closures on a plurality of outputs and said scale keys are connected to at least enough of the plurality of outputs to generate scale notes from the chord generation frequencies in response to scale key closures.

21. An electronic musical instrument which comprises:

an oscillator for producing a fundamental frequency, a keyboard including a plurality of scale keys and a plurality of chord keys, a programmable frequency divider connected to said oscillator for dividing said fundamental frequency to produce different output frequencies on a plurality of outputs depending on scale and chord key closures, sound generation means connected to receive the different output frequencies on the plurality of outputs from said programmable frequency divider, and means connected to said programmable frequency divider and to groups of the scale keys within which the playing of more than one scale note together would produce dissonant sounds for transforming any more than one note within each group being played together to another note outside the group.

22. The electronic musical instrument of claim 21 additionally comprising means operatively coupling the scale keys and the chord keys for causing the chord key closures to produce chords compatible with notes produced by scale key closures.

23. The electronic musical instrument of claim 21 in which the programmable frequency divider produces chord generation frequencies on a first group of the plurality of outputs and the scale keys are connected to at least enough of the first group of the plurality of outputs to generate scale notes at a second group of the plurality of outputs in response to scale key closures.

* * * * *